United States Patent [19]

Nelson

[11] 4,416,092

[45] Nov. 22, 1983

[54] CLEANING APPARATUS

[76] Inventor: Robert T. Nelson, 12601 Arrowhead Ter., Oklahoma City, Okla. 73120

[21] Appl. No.: 337,832

[22] Filed: Jan. 7, 1982

Related U.S. Application Data

[63] Continuation-in-part of Ser. No. 324,563, Nov. 24, 1981, abandoned.

[51] Int. Cl.[3] ..... B24C 3/02; B24C 3/06

[52] U.S. Cl. ..... 51/425; 51/429; 51/432

[58] Field of Search ..... 51/424, 432, 434, 435, 51/436, 425, 423, 429, 428, 433, 412, 268, 431, 410

[56] References Cited

U.S. PATENT DOCUMENTS

| | | | |
|---|---|---|---|
| 209,173 | 10/1878 | Kidwell et al. | 51/428 |
| 923,100 | 5/1909 | Young | 51/431 |
| 2,159,051 | 5/1939 | Quinn | 51/433 |
| 2,254,234 | 9/1941 | Minich | 51/433 |
| 2,635,284 | 4/1953 | Hunt | 51/417 |
| 3,704,552 | 12/1972 | Beaver et al. | 51/412 |
| 3,877,175 | 4/1975 | Snyder | 51/425 |
| 4,202,141 | 5/1980 | Fricke | 51/424 |
| 4,254,593 | 3/1981 | Paulfeuerborn | 51/425 |
| 4,336,671 | 6/1982 | Nelson | 51/424 |
| 4,364,823 | 12/1982 | Goff | 51/429 |

FOREIGN PATENT DOCUMENTS

| | | | |
|---|---|---|---|
| 2900 | of 1870 | United Kingdom | 51/431 |
| 32161 | 7/1981 | United Kingdom | 51/424 |

*Primary Examiner*—Frederick R. Schmidt
*Assistant Examiner*—Robert A. Rose
*Attorney, Agent, or Firm*—Bernard, Rothwell & Brown

[57] ABSTRACT

The cleaning apparatus includes a wheel in the form of a rapidly rotating drum having relatively few blades spaced circumferentially about the periphery thereof and extending radially thereon. Abrasive material is delivered from a hopper through a slot and is picked up by the blades of the rapidly rotating drum and delivered with extremely high kinetic energy into the surface to be cleaned. The apparatus is constructed so that the recovery path of the abrasive material from the surface to be cleaned and the delivery path of the abrasive material directed to the surface to be cleaned are in the same plane and in the same plane as the plane of rotation of the drum. The recovery path is generally contiguous with the housing of the drum, creating a compact apparatus which utilizes the normal path of movement of the recovered abrasive material. By providing an apparatus in which the delivery and recovery paths are both essentially in the same plane and in the plane of the rotating drum, the size of the apparatus required is reduced, wear on the components of the apparatus is significantly reduced, the construction is simplified and the cost is reduced.

5 Claims, 2 Drawing Figures

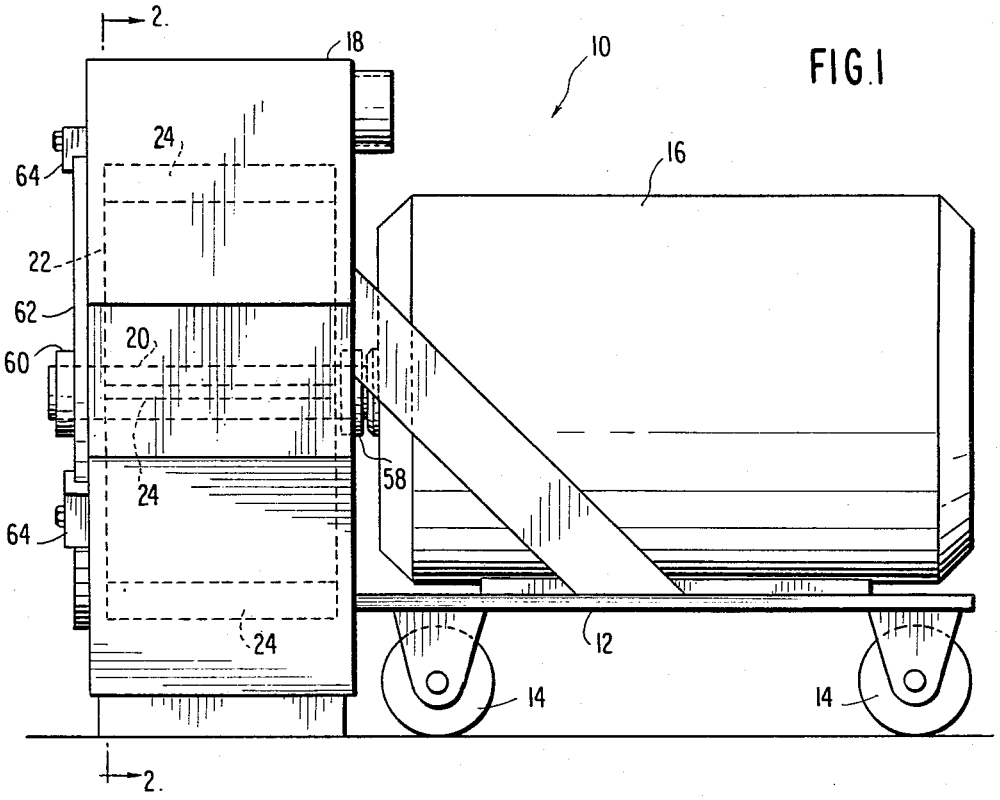
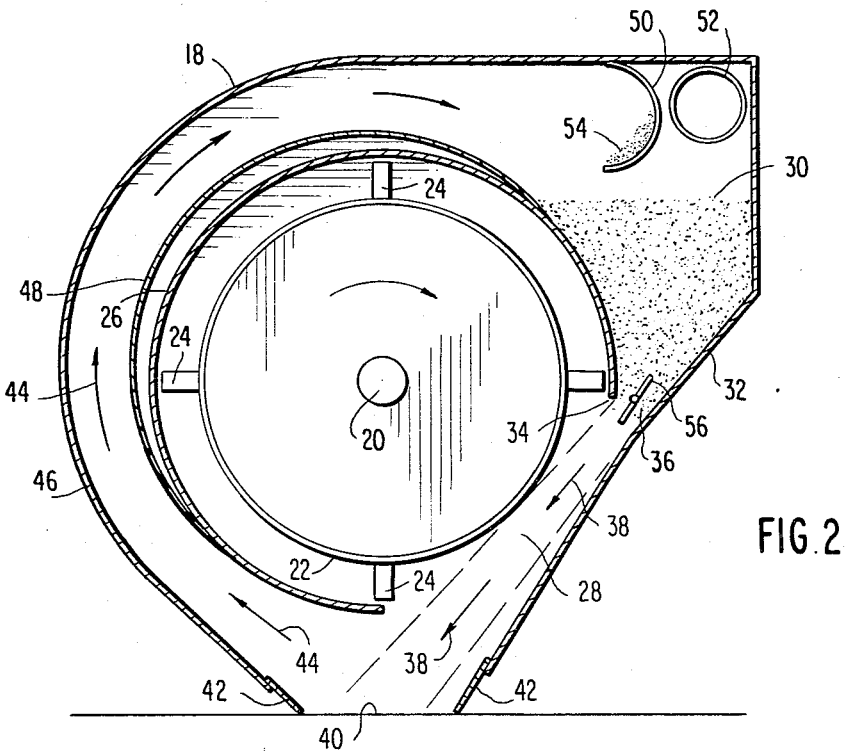
FIG.2

CLEANING APPARATUS

This application is a continuation-in-part of application Ser. No. 324,563, filed Nov. 24, 1981, now abandoned.

BACKGROUND OF THE INVENTION

1 Field of the Invention

This invention relates to mobile surface treating apparatus in which abrasive is impacted against the surface to be treated, removed from the surface to prevent substantial accumulation of spent abrasive on the surface, and recycled for subsequent use in the apparatus.

2. Description of the Prior Art

The cleaning of large surfaces, e.g., metal, concrete and the like, may be periodically desired, for instance, to prepare the surface for painting. In the past, air blasting with crushed slag or sand has been employed to clean the surface; however, air blasting requires compressed air which is often expensive and often contains moisture such that, for instance, the reoxidation of a treated metal surface prior to the application of protective coatings may be increased. Additionally, air blasting generally requires a larger labor force. Moreover, the abrasives commonly employed in air blasing, such as crushed slag, are subject to considerable disintegration on impact with the surface being treated, and thus are generally not recycled. Further labor is required to effect clean-up of spent abrasive in the area of the surface treating operation. Also, air blasing can be an environmental hazard due to the excessive amounts of dust created, and thus, protective equipment must often be provided to insure the safety of personnel in the area of the surface treating operation.

As an alternative, it has been proposed to employ centrifugal blasting wheels to propel particulate abrasive material at high velocity against the surface being treated and to recover the abrasive for reuse. Apparatus employing centrifugal blasting wheels and means for recovery of spent abrasive material are disclosed, for instance, in U.S. Pat. No. 3,691,689. In accordance with that patent, spent abrasive material is swept into a collection bin by a rotating broom positioned behind the blast area. Such apparatus have significantly decreased the operating costs for treating surfaces, and since the blast area can be enclosed, the escape of dust from the system can be minimized, thereby increasing the safety of personnel in the area of treatment as compared to conventional air blasting operations.

Other proposals for surface treating apparatus have included the use of the kinetic energy of the abrasive material to rebound abrasive material from the surface being treated to a collection hopper for gravity feed to a centrifugal throwing wheel. For instance, in U.S. Pat. No. 3,977,128 to James R. Goff, there is disclosed an abrasive material throwing machine wherein abrasive material is projected by a centrifugal throwing wheel to impact the surface being treated at an inclined angle and has a predetermined angle of rebound into a rebound path. In order to direct the rebounding abrasive material to a storage hopper which is positioned above the centrifugal throwing wheel, rotary brushes are employed.

Some problems which have characterized blasting apparatus, such as those discussed above, employing abrasive materials for cleaning purposes result from the rather large size and complexity of the apparatus. This has created difficulty in cleaning areas confined by wall space or otherwise constricted, made these apparatus more difficult to move from one location to another, created problems of storage between operations and rendered the apparatus unusually costly.

Many of these apparatus have employed a blast pattern and recovery path which forces the abrasive material substantially out of the plane of rotation of the centrifugal wheel, propelling the abrasive material through a convoluted path, before it is returned to a hopper for redelivery and reuse. This involves a change of direction from the natural flow path the abrasive material would otherwise take.

Portions of the apparatus employed to effect such a change in direction are subjected to unusual wear and elevators or other recovery apparatus are required to insure that the abrasive material is returned to the hopper for redelivery. To accommodate this wear through the use of liners and heavier gauge metals and to provide the additional apparatus for recovery and redelivery raises the cost of the operation as well as the power requirements for the centrifugual wheel.

Many of the prior art blasting apparatus employ a centrally fed centrifugal wheel driven by a motor for propelling the abrasive toward the surface to be treated. The use of this type of apparatus has certain limitations imposed by the centrifugal wheels which limitations ultimately adversely affect the cleaning capcity of the abrasive. With a centrifugal wheel the speed with which the wheel can be driven is somewhat limited. The blades tend to break off at relatively high speeds, jam the system, and otherwise adversely effect the propulsion or kinetic energy imparted to the abrasive. By limiting the speed of the centrifugual wheel to avoid the breaking of the blades and other adverse effects, there is a corresponding limitation in the force or kinetic energy that can be imparted to the abrasive material. This, of course, derogates from the overall effectiveness of the blasting apparatus. Moreover, apparatus of this type normally employs an impeller and a control cage both of which can be eliminated with the apparatus of this invention.

By the apparatus of this invention the problems and limitations of the prior art apparatus discussed above have been overcome and a much more efficient, effective and compact cleaning apparatus, with reduced wear, has been provided.

SUMMARY OF THE INVENTION

In carrying out the invention, in one form thereof, the cleaning apparatus includes a wheel in the form of a rapidly rotating drum having relatively few blades spaced cicumferentially about the periphery thereof and extending radially thereon. Abrasive material is delivered from the hopper through a slot and is picked up by the blades of the rapidly rotating drum and delivered with extremely high kinetic energy onto the surface to be cleaned. The apparatus is constructed so that the recovery path of the abrasive material from the surface to be cleaned and the delivery path of the abrasive material directed to the surface to be cleaned are in the same plane and in the same plane as the plane of rotation of the drum. The recovery path is generally contiguous with the housing for the drum, creating a compact apparatus which utilizes the normal path of movement of the recovered abrasive material. By providing an apparatus in which the delivery and recovery paths are both essentially in the same plane and in the plane of the rotating drum, the size of the apparatus required is reduced, wear on the components of the apparatus is significantly reduced, the construction is simplified and the cost is reduced.

BRIEF DESCRIPTION OF THE DRAWINGS

FIG. 1 is a elevation side view of the blasting apparatus of the invention.

FIG. 2 is a Sectional view taken generally along lines 2—2 in FIG. 1.

DETAILED DESCRIPTION OF THE PREFERRED EMBODIMENT

As can be seen in FIG. 1 the blasting apparatus, designated generally by reference numeral 10, is supported by a support structure 12 on four casters 14 which enable the apparatus to be moved readily across the horizontal surface to be cleaned. An electric motor generally indicated at 16 is mounted on the support structure 12 adjacent a housing 18. The motor is connected to a shaft 20 which extends through the housing. Fixed to shaft 20, as can be more clearly seen in FIG. 2, is a wheel or rotatable drum 22 having a plurality of blades 24 equally spaced about the periphery of the drum and extending radially therefrom. While in the particular embodiment illustrated four blades 24 are employed, a greater or lesser number of blades could be employed if desired.

The blades 24 may be made integral with the drum or, alternatively, they may be formed separately from the drum and attached to the drum in any suitable manner. This latter construction facilitates replacement of the blades after they have become worn, and eliminates the necessity to replace the entire drum because of such wear.

The delivery and recovery paths for the abrasive material, the arrangement of which constitutes a significant aspect of this invention, are best illustrated in FIG. 2. Referring now to FIG. 2, it can be seen that the drum 22 is partially enclosed by a drum housing 26 which circumscribes a major portion of the drum 22 and is displaced slightly therefrom in the radial direction so that the blades 24 may freely rotate therein. The drum housing 26 is formed to include an open portion or opening 28 which constitutes approximately one-quarter of the circumference of the housing and is located in the lower right quadrant, as viewed in FIG. 2; that is, the drum housing 26 extends around approximately three-quarters of the periphery of the drum. A hopper 30 for containing abrasive material, for example shot, to be supplied to the surface to be cleaned is disposed in the upper right quadrant of the housing 18, as viewed in FIG. 2. One portion of the hopper 30 is formed by a section of the drum housing 26 and the other portion of the hopper is formed by portion 32 of the wall of the housing 18. The portion 32 of the housing 18 and one end 34 of the drum housing 26 are spaced to provide an elongated opening or slot 36 which extends tranversely of the drum, that is, in a direction parallel to the axis of the drum. The slot or opening 36 is slightly shorter than the width of the drum and of the blades 24 associated therewith; that is, for example, if a drum of a 12-inch width were employed the slot 36 would be approximately 10 inches in length.

The abrasive material from the hopper 30 is delivered in the direction of the arrows 38 to the surface 40 to be treated. This delivery is effected with extremely high kinetic energy by the rapidly rotating blades 24 which pass in rapid succession across the slot or opening 36 and in effect "slice" a thin longitudinal sliver (for example, about 1/16 inch thick) from the abrasive material at the bottom of the hopper 30 and deliver it with extremely high kinetic energy along the aforementioned path against the surface 40 to be cleaned. The housing 18 is formed to define a lower opening corresponding to the surface 40 to be cleaned in order to expose this surface to the force of the abrasive material being propelled by the rotatable drum 22. A flexible skirt 42 is provided extending around a periphery of the aforementioned opening in order to seal this opening from the surrounding atmosphere and to prevent the abrasive material and debris from the surface being cleaned from escaping into the surrounding area.

It can be seen that the path of delivery of the abrasive material as indicated by the arrows 38 is in the plane of rotation of the drum 22. In accordance with this invention, the recovery path of the abrasive, material ricocheting from the surface being cleaned is also arranged in the plane of rotation of the drum, that is the delivery path for the abrasive material and the recovery path for the abrasive material being returned to the hopper are in the same plane and in the plane of rotation of the drum. The recovery path is indicated by the arrows 44 in FIG. 2. This recovery path is formed by a portion 46 of the housing 18 and a wall 48 formed in part by the drum housing 26. The wall 48 is spaced from the portion 46 of the housing 18 to provide an enclosed substantially unobstructed flow path for the recovered abrasive material.

The abrasive material is delivered by the rotating drum 22 to the surface to be cleaned with sufficient kinetic energy that the rebounding abrasive material is carried through the recovery path and into the hopper 30 without the need for additional power sources such as brushes and the like.

The recovered abrasive material is directed onto a transversely extending arcuate deflector 50 positioned generally at the upper right corner of the housing 18, as viewed in FIG. 2. The deflector 50 is slightly greater than a half cylinder, the arcuate surface thereof extending over an arc of approximately 190°. Adjacent the deflector is a dust collector indicated by the numeral 52. The dust collector may be of any standard type and the details thereof are unimportant to the invention. The purpose of the dust collector is to remove light dust, primarily the debris from the surface being cleaned, from the material returning along the recovery path 44. The abrasive material is heavy in character, being normally in the form of shot, and is not drawn into the dust collector.

The deflector 50 serves as a receptacle for catching the returning shot. The returning shot is caused to collect in a region of the deflector indicated by the numeral 54, so that subsequently returned shot rolls down the inclined surface provided by the pocketed shot and into the hopper 30. The hopper 30 is also positioned in the same plane as the recovery path and the delivery path.

The flow of abrasive material from the hopper 30 into the delivery path indicated by the arrows 38 can be controlled by merely providing an opening 36 of the desired size. The delivery of the abrasive material can be further controlled by an adjustable pivoted vane or butterfly valve 56 positioned adjacent the opening 36 so as to vary the effective size of the opening.

The cleaning apparatus of this invention is also constructed so as to be easily serviceable. For this purpose the drum 22 and the shaft 20 are formed as a unitary assembly. The ends of the shaft 20 extend beyond the sidewalls of the drum 22. One end of the shaft is supported by a bearing 58 positioned at the motor side of the housing 18 and fixed to the housing 18. The other end of the shaft is positioned within a supporting bearing 60 at the outboard side of the housing 18. Bearing 60 is fixed to a cover plate 62. This cover plate 62 is removably mounted to a wall of the housing 18 by a plurality of circumferentially spaced fastening members of any suitable type, two of which are shown at 64 in FIG. 1. When it is desired to repair or replace the drum, the unitary drum and shaft assembly is easily removed for this purpose by simply loosening or removing the fasteners 64 and then removing the cover plate 62. This exposes the cavity in which the drum is housed and permits the drum and shaft assembly to be easily removed therefrom. The new or repaired drum and shaft assembly is then easily positioned within the housing with one end of the shaft within the bearing 58. The cover plate 62 is then placed in position with the outboard end of shaft 20 in the bearing 60 and is secured to the housing 18 by means of the fastening members 64.

In a specific embodiment of this invention the drum 22 is rotated at a speed of about 5200 rpm and this produces a blade speed about 50% grater than that of prior art centrifugal wheels. The abrasive is, therefore, delivered against the surface to be cleaned with a very high kinetic energy which enhances the cleaning effect thereof.

In operation, shot or other suitable abrasive material is provided in the hopper 30 and is delivered to the surface 40 to be cleaned by means of the blades 24 of the rapidly rotating drum which remove even "slices" of the abrasive material from the hopper and deliver this abrasive material at extremely high kinetic energy against the surface 40 to be cleaned. Since the blades tend to remove from the hopper uniform "slices" of abrasive material the result is a very even feed onto the blades over substantially the entire length thereof and a very even feed over the surface to be cleaned. The richocheting abrasive material and any debris cleaned from the surface 40 is caused to move along the recovery path indicated by the arrows 44, which path is in the same plane as the plane of the delivery path 38 so that there is no abrupt change in direction of the abrasive material, other than that from the cleaning surface. Therefore wear on the apparatus, which in prior art structures could become excessive because of the necessity to change the direction of movement of the recovered abrasive material, is minimized. The abrasive material and collected debris move along the recovery path onto the arcuate deflector 50 and some of the abrasive material collects in a pocket in the region indicated at 54. Further abrasive material as it returns to the deflector 50 rolls over the surface of the pocketed abrasive material and downwardly into the hopper 30 for reuse. The light dust, comprising primarily the material cleaned from the surface 40, is picked up by the dust collector 52. It can be seen that the apparatus of this invention has its delivery path and its recovery path arranged in the same plane and this plane is also in the plane of the rotating drum, so that the abrasive material moves in a continuous path in a common plane. The abrasive material is delivered smoothly and evenly to the peripheral blades of the rotating drum and continues on a path to the surface to be cleaned and through a recovery path without any abrupt change in direction which would otherwise contribute, as in prior art apparatus, to significant wear.

Thus, the cleaning apparatus of this invention is designed to have a longer life. Also because of the arrangement of the flow paths in a common plane the cleaning apparatus can be made more compact. The apparatus also provides for delivery of the abrasive material at a higher kinetic energy for more effective cleaning. Finally, the cleaning apparatus is constructed so that when wear does occur through continued use, servicing is extremely simple.

The apparatus of this invention is substantially simpler than the centrifugal wheel type of the prior art apparatus since it does not require an impeller nor a control cage normally associated with this type of prior art apparatus.

While a specific embodiment of the cleaning apparatus has been shown and described, it will be apparent to those skilled in the art that modifications could be made without departing from the spirit and scope of this invention. For example, in lieu of the drum and peripheral blades employed in the embodiment illustrated the blades could be constructed to extend from a central hub. Also, while the apparatus has been illustrated and described as employed for cleaning horizontal surfaces, and this is presently the predominant expected use of the apparatus, cleaning apparatus made in accordance with this invention could also be employed for cleaning generally vertical surfaces, for example, the sides of ships. It is intended by the appended claims to cover all such modifications as fall within the spirit and scope of this invention.

I claim:

1. An apparatus for movement over a surface external of the apparatus to clean the surface with abrasive material comprising:

(a) a housing having an enclosure with an opening for exposing a portion of the surface external of said housing to abrasive material from the apparatus;

(b) a rotatable drum within said housing, said drum including a plurality of circumferentially spaced blades extending radially from the peripheral surface of the drum for propelling abrasive material along a delivery path toward the surface to be treated;

(c) a hopper for storing abrasive material, said hopper having an opening communicating with said delivery path;

(d) means for delivering abrasive material from said hooper to said drum for propulsion of the abrasive material toward said housing opening, said means including said hopper opening and said blades, said blades being positioned to pass across said hopper opening in close proximity thereto for revoving abrasive material from said hopper and projecting it along said delivery path;

(e) said housing including a substantially unobstructed recovery path for receiving abrasive material rebounding from the surface being treated and returning the rebounding abrasive material to said hopper;

(f) said drum imparting sufficient kinetic energy to abrasive material delivered thereto to effect cleaning of the surface to be treated and to return rebounding abrasive material to said hopper;

(g) a drum housing substantially circumscribing said drum, said drum housing having an opening comprising a minor portion thereof to provide for delivery of abrasive material from said hopper to said blades and providing space for said delivery path, said hopper having an elongated opening at the bottom aligned with said drum housing opening so that small even slices of abrasive material are successively removed from said hopper by said blades and propelled along said delivery path; and (h) said delivery path, the plane of rotation of said drum, said recovery path and said hopper lying in the same plane.

2. The apparatus according to claim 1 wherein said recovery path substantially circumscribes said wheel.

3. The apparatus according to claim 1 further comprising support means for supporting the apparatus on a horizontal surface, wherein the said same plane is substantially perpendicular to the surface being treated.

4. The apparatus according to claim 1 further comprising control means disposed adjacent said hopper opening for controlling the amount of abrasive material delivered to said drum.

5. The apparatus according to claim 4, wherein said control means is an adjustable pivoted vane.

* * * * *

UNITED STATES PATENT AND TRADEMARK OFFICE

CERTIFICATE OF CORRECTION

PATENT NO. : 4,416,092

DATED : November 22, 1983

INVENTOR(S) : Robert T. Nelson

It is certified that error appears in the above-identified patent and that said Letters Patent is hereby corrected as shown below:

Column 1, line 31, "blasing" should be --blasting--.

Column 5, line 26, "grater" should be --greater--.

Column 6, line 50, "hooper" should be --hopper--.

Column 8, line 2, "wheel" should be --drum--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*